United States Patent [19]

Grimm

[11] Patent Number: 4,579,339

[45] Date of Patent: Apr. 1, 1986

[54] BASKETBALL RETURN

[76] Inventor: Alan P. Grimm, 323 3rd St., Manning, Iowa 51455

[21] Appl. No.: 739,468

[22] Filed: May 29, 1985

[51] Int. Cl.[4] ..... A63B 63/08

[52] U.S. Cl. ..... 273/1.5 A

[58] Field of Search ..... 273/1.5 R, 1.5 A, 396

[56] References Cited

U.S. PATENT DOCUMENTS

| | | | |
|---|---|---|---|
| D. 260,669 | 9/1981 | Armstrong | D21/201 |
| D. 260,670 | 9/1981 | Armstrong | D21/201 |
| 2,278,616 | 4/1942 | Kettering | 273/1.5 R |
| 3,717,342 | 2/1973 | Haney et al. | 273/1.5 A |
| 3,776,550 | 12/1973 | McNabb | 273/1.5 A |
| 3,814,421 | 6/1974 | Spier, Jr. | 273/1.5 A |
| 3,901,506 | 8/1975 | Caveney | 273/1.5 A |
| 3,913,916 | 10/1975 | Martin, Jr. | 273/396 |
| 3,917,263 | 11/1975 | Wiley | 273/1.5 A |
| 3,945,638 | 3/1976 | Luebkeman | 273/1.5 A |
| 4,089,525 | 5/1978 | Palazzolo | 273/375 |
| 4,291,885 | 9/1981 | Cohen | 273/347 |

*Primary Examiner*—Paul E. Shapiro

*Attorney, Agent, or Firm*—Lucas J. De Koster

[57] ABSTRACT

A device adapted to be attached to a basketball hoop to provide for a directed return of the basketball after a successful shot. The device includes a frame supporting a directed slide adapted to direct the ball back toward the shooter. Hooks, at least one of which is springably movable away from the hoop, are used to hold the device on the hoop.

3 Claims, 3 Drawing Figures

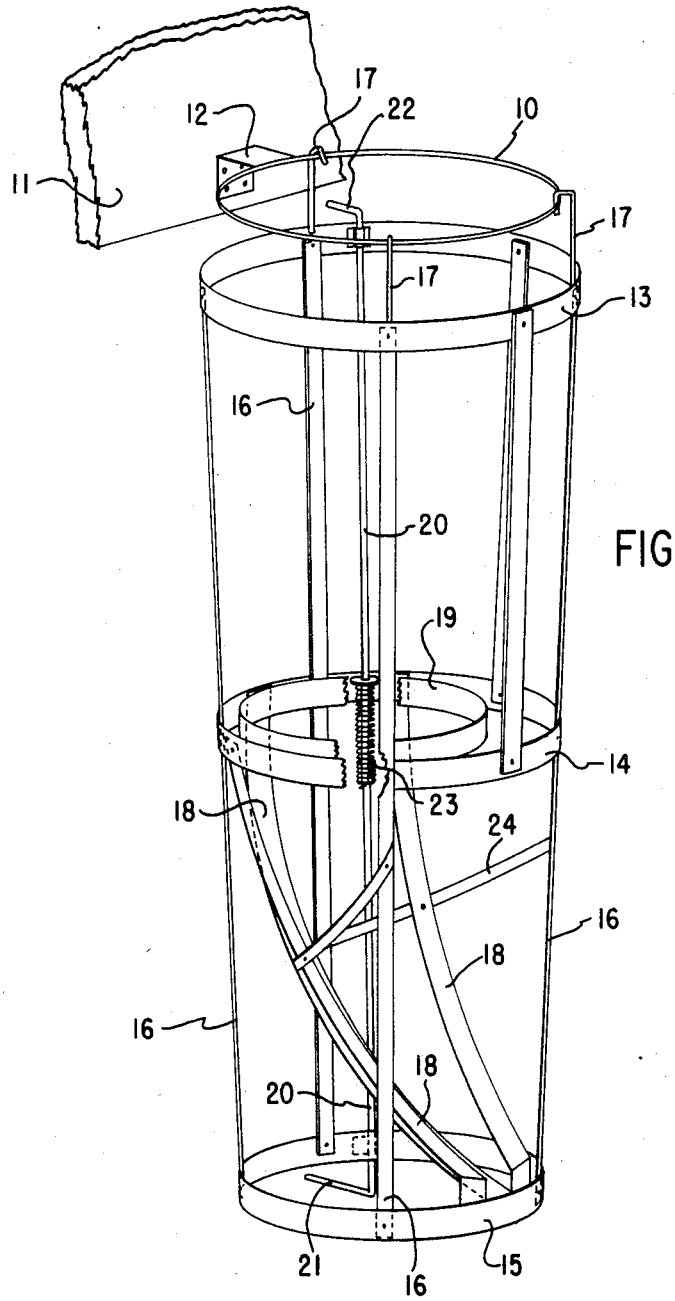
FIG. 1
FIG. 2
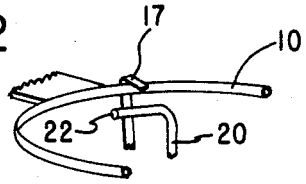
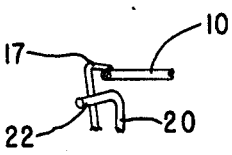
FIG. 3

BASKETBALL RETURN

BACKGROUND AND SUMMARY OF THE INVENTION

This invention pertains to sporting equipment and more particularly to a device to make easier the practicing of basketball set shots including free throws.

Basketball is a sport in which a great deal of emphasis is placed on the ability to toss a ball accurately through a hoop. Such accuracy is developed principally by practice. That practice can readily be done by a person alone simply shooting the ball repeatedly at the hoop.

There are various types of shots used in the sport. Some are principally taken while the participant is in running motion, but others known as set shots are taken from a set position, and a particular kind of set shot is the free throw, always taken from a relatively fixed position. It is principally the practicing of set shots at which my invention is directed.

When one is practicing set shots, the goal is to strive for accuracy from a set position. Therefore, it is desirable to have the ball returned to that position for successive practice shots. When there are two or more participants, it is easy for one participant to retrieve the ball after each shot and to return it to the shooter. However, when there is only a single participant, that practicer must, in each instance, retrieve the ball and return to the position from which he is practicing the shot. By my invention, I provide a device relieving the practicing athlete from the need to retreive the ball after those shots which are successful.

FIGURES

FIG. 1 is a pictorial view of my device suspended in place from a basketball hoop.

FIG. 2 is a detailed view of the hook release device about to remove the hook, and FIG. 3 is a view like FIG. 2 with the hook released.

DESCRIPTION

Briefly my device comprises a framework including a directed chute adapted to be hung from a basketball hoop. The chute is adapted to receive the ball and direct it back toward the player. Novel means of detaching the framework for the hoop is also provided.

More specifically and referring to the drawing, I provide a framework adapted to be hung from the normal hoop 10 used as a goal in basketball. This hoop is attached to a backboard 11 by means of the conventional bracket 12.

The framework consists of three rings which may be of similar size or may be tapered in diameter. These rings include an upper ring 13, a middle ring 14 and a lower ring 15. A series of stringers 16 hold the rings in fixed spaced relation.

At the upper end of three of the stringers 16 I provide hooks 17 adapted to hook over the rim 10. These hooks extend above the upper ring 13, and are flexible enough so that at least one of them can be quite easily flexed away from the rim to allow the one hook to be detached and the device to be removed from the rim. The mechanism for this purpose will be described later.

The stringers 16 are spaced so that there is sufficient space between the two of them which define the front of the device that a basketball may readily pass between them above the lower ring 15. At the upper end, the spacing of the hooks 17 should be such that none of the hooks interferes with the bracket 12 in any normal position of the device.

The mechanism to provide for the hanging of the device includes three hooks 17 extending upward from the upper ring 13. As noted above at least one of these hooks is made of a spring-type material (either metal or plastic) so that it can be spread apart and will then spring back into its original position. Two of the hooks—preferably those on the front of the device—that is, the part farthest removed from the bracket 12 of the basket ring—are simply used in that form. The third hook has an adjacent device adapted to permit easy hooking or unhooking of the device from the ring 10.

The unhooking mechanism consists of a rod 20 mounted on the rings 13 and 15 so that it can be slid vertically and also turned. At its lower end, the rod 20 is formed with a handle 21 which may be simply the leg of an L-shape formed by bending the rod 20. The upper end of the rod 20 is placed to be adjacent the third hook 17—preferably the rear hook. Here the rod 20 is also bent to provide a hook engaging leg 22. This leg is disposed just inside the hook 17 so that when the rod 20 is turned, the leg 22 will engage the hook. This engagement, especially when it takes place near end of the hook 17 nearest the hoop 10, can be used to displace the hook somewhat because of the springable material from which the hook is made. Therefore, the hook can be moved outwardly of the circle formed by the upper ring 13 and so can be spread apart away from the hoop on ring 10 to allow either hooking or releasing of the hook 17 from the ring.

In order to keep the leg 22 away from the hoop 10 and therefore out of the line of passage of the ball through the hoop, I provide a spring 23 adapted to bias the rod 20 in a downward direction. I envision that the spring 23 could also be a torsion spring usable to bias the leg 22 lightly against the hook 17 so that the leg 22 would normally be withdrawn from any passage taken by the basketball entering the upper ring 13.

In addition to the stringers 16, a series of strips 18 extends from the middle ring 14 to the lower ring 15. These strips are arranged to form a chute as shown in the figure. The chute starts at an inner ring 19 at the same level as the middle ring 14. The diameter of the ring 19 is slightly larger than the standard sized basketball so that the ball can go through the ring. From there it rolls down the chute formed by the strips 18 and out between the stringers 16 at the front of the device. A support strip 24 may be used to hold the strips 18 in proper relative position.

In use, the two front hooks 17 are placed over the hoop 10. Then the rod 20 is used to spring the rear hook 17 outwardly clear of the hoop. This is accomplished by pressing the rod upwardly and turning it so that the leg 22 presses against the hook 17. Then the device is raised so that the rear hook 17 is above the hoop 10. The hook is then allowed to spring back to normal position and engage the hoop 10. The device is pulled downwardly so that all the hooks are firmly against the hoop and the device is ready for use.

If the set place for practice is directly in front of the backboard as in practicing free throws, the device is adjusted so that the delivery opening between the stringer 16 faces the practicing individual. If one wants to practice from some other position on the court, the device can be turned somewhat on the hoop so that the chute will direct the ball to another position in the practice area.

I claim as my invention:

1. For attachment to a basketball hoop a practice device comprising a framework adapted to be hung from said hoop, at least three hooks on said framework adapted to hook over said hoop, at least one of said hooks being springably movable in a direction radially of said hoop, release means on said framework adapted to engage said springably movable hook to move that hook away from said hoop, chute means formed in said framework adapted to receive a ball falling through said hoop, said chute having an outlet through the side of said framework, said framework being adjustable on said hoop by sliding said hooks over said hoop so that said outlet can be adjustably directed.

2. The device of claim 1 in which said release means includes a rod slidably and rotatably mounted on said framework, means on said rod adapted to engage said springably mounted hook and handle means on said rod by which said rod can be moved both slidably and rotatably 3. The device of claim 2 in which spring means is engaged between said rod and said framework to bias said release means to a position not in contact with said hook.

* * * * *